United States Patent [19]

Otte

[11] Patent Number: 4,985,939

[45] Date of Patent: Jan. 22, 1991

[54] TOILET SEAT HINGE ASSEMBLY

[75] Inventor: Timothy J. Otte, Sheboygan Falls, Wis.

[73] Assignee: Bemis Manufacturing Company, Sheboygan Falls, Wis.

[21] Appl. No.: 387,629

[22] Filed: Jul. 31, 1989

[51] Int. Cl.[5] ..... A47K 13/10

[52] U.S. Cl. ..... 4/240; 4/241; 4/251; 16/290; 49/386

[58] Field of Search ..... 4/236, 240, 241, 251; 49/379, 386; 16/289, 290

[56] References Cited

U.S. PATENT DOCUMENTS

| | | | |
|---|---|---|---|
| 566,621 | 8/1896 | Rider et al. . | |
| 900,514 | 10/1908 | Geary | 4/241 |
| 2,074,318 | 3/1937 | Bachmann . | |
| 2,181,017 | 11/1939 | Hill | 4/241 X |
| 2,214,323 | 9/1940 | Carter . | |
| 2,410,854 | 11/1946 | Zulkoski . | |
| 2,440,232 | 4/1948 | Davidson . | |
| 2,448,330 | 8/1948 | Sperzel | 4/236 |
| 2,636,185 | 4/1953 | Boston . | |
| 2,729,416 | 1/1956 | Waas | 49/386 |
| 2,744,264 | 5/1956 | Sperzel | 4/240 X |
| 2,772,422 | 12/1956 | Knudsen . | |
| 2,814,049 | 11/1957 | Mercur . | |
| 2,852,786 | 9/1958 | Reinhard | 4/236 |
| 2,901,753 | 9/1959 | Sperzel | 4/236 X |
| 2,954,565 | 10/1960 | Miller . | |
| 3,001,227 | 9/1961 | Long et al. | 16/290 |
| 3,316,561 | 5/1967 | Newkirk . | |
| 3,452,388 | 7/1969 | Stone | 16/290 |
| 3,550,164 | 12/1970 | Pease | 4/236 |
| 4,133,062 | 1/1979 | Fulbright, Jr. . | |
| 4,195,372 | 4/1980 | Farina . | |
| 4,338,690 | 7/1982 | Hsieh et al. . | |
| 4,426,743 | 1/1984 | Seabrooke . | |
| 4,428,083 | 1/1984 | Chuang . | |
| 4,470,161 | 9/1984 | Seabrooke . | |
| 4,551,866 | 11/1985 | Hibbs . | |
| 4,592,097 | 6/1986 | Zimmerman . | |

FOREIGN PATENT DOCUMENTS

| | | | |
|---|---|---|---|
| 1001099 | 2/1952 | France | 4/241 |

*Primary Examiner*—Henry J. Recla
*Assistant Examiner*—Robert M. Fetsuga
*Attorney, Agent, or Firm*—Michael, Best & Friedrich

[57] ABSTRACT

Disclosed herein is a hinge assembly comprising a housing adapted to engage a toilet bowl and comprising an internal cavity including a bottom opening, and a cylindrical bearing surface having a horizontally extending axis, a hinge member supported by the bearing surface for rotation about the axis and including a hinge pin extending co-axially with the cylindrical portion and outwardly of the housing and adapted to be fixedly engaged with a toilet seat to effect toilet set rotation in common with rotation of the hinge member about the axis, an elongated actuating link extending into cavity in the housing through the bottom opening and including an upper end a lower stud portion having a lower threaded part, and an upper end connected to the hinge member for effecting rotation of the hinge member in response to link movement in the direction of link elongation, a nut adjustably threaded on the threaded lower part of the stud portion, and a helical spring located in encircling relation to the stud portion and between the toilet bowl and the nut and operative to bias the link downwardly and to retaining the housing in tight engagement on the toilet bowl.

11 Claims, 1 Drawing Sheet

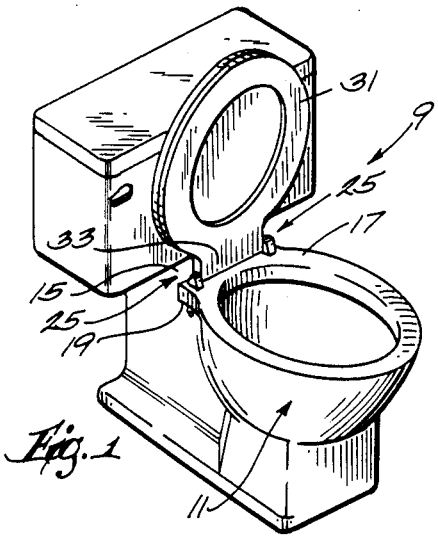
Fig. 1
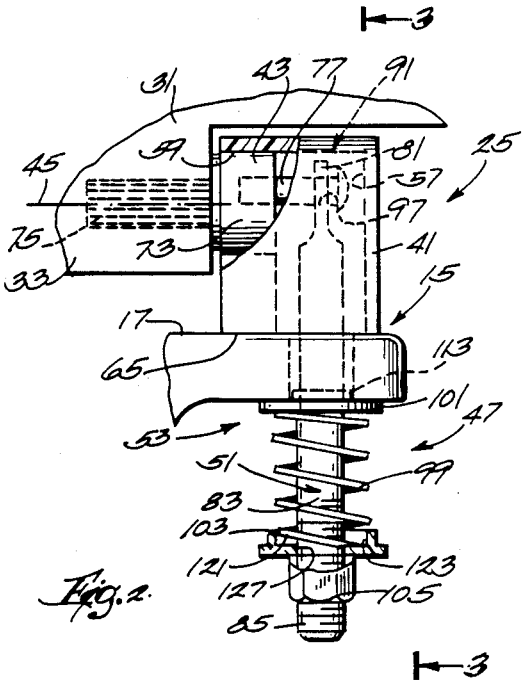
Fig. 2.
Fig. 3
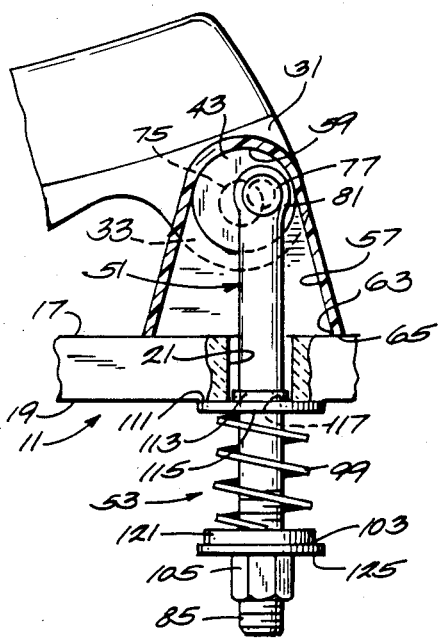
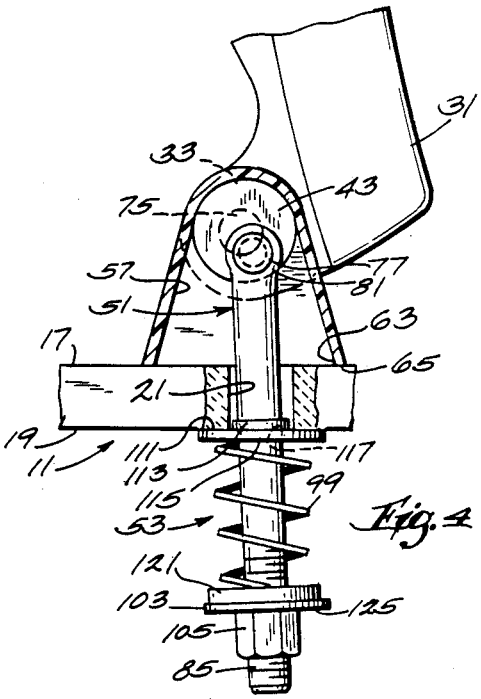
Fig. 4

TOILET SEAT HINGE ASSEMBLY

BACKGROUND OF THE INVENTION

1. Field of the Invention

The invention relates generally to the mounting of toilet seats on toilet bowls. More particularly, the invention relates to hinge assemblies for movably mounting toilet seats on toilet bowls for movement between horizontal and vertical positions. Still more particularly, the invention relates to hinge assemblies arranged to bias the toilet seat to the raised or vertical position.

2. Reference to Prior Art

Numerous attempts to devise mechanisms for raising a toilet seat to a near vertical position, following its use in the horizontal or sitting position, have been made over many past years. Customarily, male users of toilet seats have urinated from the standing position, not infrequently contaminating the seat when left in the horizontal position, to the understandable discomfort of female users who may follow. Although anatomically male users are perfectly capable of performing this function from a sitting position, training to adapt to this mode is apparently so damaging to the masculine ego that a desire to remove the seat automatically from the target zone has persisted over the years.

Although some self-rising toilet seats are known, in general they have not been accepted. More particularly, prior self rising seats having been either aesthetically undesirable, complex, and expensive, or some combination of all three. Many call for attachment to the floor as well as to the seat, creating not only unsightly systems of levers and springs, but make dirt traps that are hard to clean. Others call for box-like structures to be added to the hinge area, again creating cleaning problems, or have enlarged and complex hinge devices that house torsion springs with adjusting devices that are expensive to manufacture.

Attention is directed to the following U.S. Pat. Nos.:

| | | |
|---|---|---|
| 566,621 | 2,772,422 | 4,338,690 |
| 2,074,318 | 2,814,049 | 4,426,743 |
| 2,214,323 | 2,954,565 | 4,428,083 |
| 2,410,854 | 3,316,561 | 4,470,161 |
| 2,440,232 | 4,133,062 | 4,551,866 |
| 2,636,185 | 4,195,372 | 4,592,097 |

SUMMARY OF THE INVENTION

The invention provides a self rising toilet seat assembly comprising a toilet seat, a toilet bowl having an upper surface, a lower surface, and an opening extending between the surfaces, and a hinge assembly comprising a housing engaging the upper surface of the toilet bowl and comprising an internal cavity including a bottom opening, and a cylindrical bearing surface having a horizontally extending axis, a hinge member supported by the bearing surface for rotation about the axis and including a hinge pin extending outwardly of the housing, and fixedly engaged with the toilet seat to effect toilet seat rotation in common with rotation of the hinge member about the axis, an elongated actuating link extending through the opening in the toilet bowl and into the cavity in the housing through the bottom opening and including an upper end and a lower stud portion having a lower threaded part, means on the upper end of the link and on the hinge member for effecting rotation of the hinge member in response to link movement in the direction of link elongation, and means for biasing the link downwardly and comprising a nut adjustably threaded on the threaded lower part of the stud portion, and a helical spring located in encircling relation to the stud portion, and between the lower surface of the toilet bowl and the nut.

The invention also provides a self rising toilet seat assembly comprising a toilet seat having a rearward portion, a toilet bowl having an upper surface, a lower surface, and an opening extending between the surfaces, and a hinge assembly comprising a housing engaging the upper surface of the toilet bowl and comprising an internal cavity including a bottom opening, and a cylindrical bearing surface having a horizontally extending axis, a hinge member including a cylindrical portion supported by the bearing surface for rotation about the axis, a hinge pin extending co-axially with the cylindrical portion and outwardly of the housing, and fixedly engaged with the rearward portion of the toilet seat to effect toilet seat rotation in common with rotation of the hinge member about the axis, and an operating pin extending in the cavity and located in eccentric relation to the axis, an elongated actuating link extending through the opening in the toilet bowl and into the cavity in the housing through the bottom opening and including a lower stud portion having a lower threaded part, and an upper end operably connected to the operating pin to effect rotation of the hinge member in response to link movement in the direction of link elongation, and means for biasing the link downwardly and for retaining the housing in tight engagement on the upper surface of the toilet bowl and comprising a locating washer having an upper face engaging the lower surface of the toilet bowl, a boss extending from the upper face and loosely received in the opening in the toilet bowl, a lower face, and a central aperture through which the stud portion extends, a cupped washer located in spaced relation to the locating washer and including a lower surface, an upper surface having therein a recess, and a central aperture through which the stud portion extends, a helical spring located in encircling relation to the stud portion, and between, and in engagement with, the lower surface of the locating washer and the recess in the lower washer, and a nut adjustably threaded on the threaded lower part of the stud portion and in engagement with the lower surface of the lower washer to adjustably compress the spring so as to yieldably locate the toilet seat in a vertical position and effect tight engagement of the housing o the upper surface of the toilet bowl.

The invention also provides a hinge assembly comprising a housing adapted to engage a toilet bowl and comprising an internal cavity including a bottom opening, and a cylindrical bearing surface having a horizontally extending axis, a hinge member supported by the bearing surface for rotation about the axis and including a hinge pin extending co-axially with the cylindrical portion and outwardly of the housing and adapted to be fixedly engaged with a toilet seat to effect toilet seat rotation in common with rotation of the hinge member about the axis, an elongated actuating link extending into the cavity in the housing through the bottom opening and including an upper end, and a lower stud portion having a lower threaded part, means on the upper end of the link and on the hinge member for effecting rotation of the hinge member in response to link movement in the direction of link elongation, and means for biasing the link downwardly so as to rotate the hinge member and comprising a nut adjustably threaded on the threaded lower part of the stud portion, and a helical spring located in encircling relation to the stud portion and between the toilet bowl and the nut.

The invention also provides a hinge assembly comprising a housing adapted to engage a toilet bowl and comprising an internal cavity including a bottom opening, and a cylindrical bearing surface having a horizontally extending axis, a hinge member including a cylindrical portion supported by the bearing surface for rotation about the axis, a hinge pin extending co-axially with the cylindrical portion and outwardly of the housing, and adapted to be fixedly engaged with a toilet seat to effect toilet seat rotation in common with rotation of the hinge member about the axis, and an operating pin extending in the cavity and located in eccentric relation to the axis, an elongated actuating link extending into the cavity in the housing through the bottom opening and including a lower stud portion having a lower threaded part, and an upper end operably connected to the operating pin to effect rotation of the hinge member in response to link movement in the direction of link elongation, and means for biasing the link downwardly so as to rotate the hinge member and to retain the housing in tight engagement on the upper surface of the toilet bowl and comprising a locating washer having an upper face adapted to engage the toilet bowl, a locating boss extending from the upper face and adapted to be loosely received in the opening in the toilet bowl, a lower face, and a central aperture through which the stud portion extends, a cupped washer located in spaced relation to the locating washer and including a lower surface, an upper surface having therein a recess, and a central aperture through which the stud portion extends, a helical spring located in encircling relation to the stud portion, and between, and in engagement with, the lower surface of the locating washer and the recess in the lower washer, and a nut adjustably threaded on the threaded lower part of the stud portion and in engagement with the lower surface of the lower washer to adjustably compress the spring so as to yieldably locate the seat in a vertical position and effect tight engagement of the housing on the upper surface of the toilet bowl.

Other features and advantages of the invention will become apparent to those skilled in the art upon review of the following detailed description, claims, and drawings.

THE DRAWINGS

FIG. 1 is a perspective view of a toilet embodying various of the features of the invention.

FIG. 2 is an enlarged fragmentary view of a portion of the constructions shown in FIG. 1 and with the toilet seat in the lower horizontal position.

FIG. 3 is a partially broken away view, taken along line 3—3 of FIG. 2.

FIG. 4 is a view similar to FIG. 3 with various of the the components in a different position, i.e, with the toilet seat in the raised position.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

GENERAL DESCRIPTION

Shown in the drawings is a toilet 9 comprising a toilet bowl 11 which can be of any suitable construction and which includes a rearward portion 15 with an upper surface 17, a lower surface 19, and a mounting aperture or opening 21 extending therebetween. While only one such aperture is shown, it should be understood that each side of the rearward portion 15 of the toilet bowl 11 includes such an aperture.

Mounted on the toilet bowl 11 by a pair of left and right hand hinge assemblies 25 (only one shown) is a toilet seat 31 which can be of any suitable constructions and which includes a rearward portion 33.

The hinge assemblies 25 are especially designed to afford fixed engagement with the toilet bowl 11 and toilet seat 31, to afford movement of the toilet seat 31 from a generally horizontal position on the toilet bowl 11 to a raised, generally vertically extending position, and to afford biasing of the toilet seat 31 to the raised position.

The hinge assemblies 25 are identical except for being left and right handed and while other specific hinge assemblies can be employed, in the disclosed construction, each hinge assembly 25 includes a housing 41 which is tightly engageable with the toilet bowl 11, a hinge member 43 carried for rotation by the housing 41 about a horizontal axis 45 and connected to the toilet seat 31 for common movement about the horizontal axis 45, and an operating mechanism 47 including an elongated member or link 51 operably connected to the hinge member 43 to afford rotation thereof in response to displacement of the link 51 in the direction of elongation, and means 53 for locating and tightly retaining or engaging the housing in the proper position on the toilet bowl, and for biasing the toilet seat to the vertical position.

More particularly, the housing 41 can be suitably constructed of any suitable plastic to include a smooth exterior surface, and to define an interior cavity 57 including a cylindrical portion or bearing surface 59 extending about the horizontal axis 45 and with an opening to the inner side of the housing 41. The cavity 57 also includes a bottom access opening 63 defined by a bottom surface 65 engaged with the upper surface 17 of the toilet bowl 11 and communicating with the opening 21 in the toilet bowl 11.

The hinge member 43 can also be suitably fabricated of any suitable plastic and includes a central cylindrical portion 43 which is rotatably supported by the cylindrical portion or bearing surface 59 of the cavity 57 to afford rotation of the hinge member 43 relative to the housing 41.

The hinge member 43 also integrally includes a hinge pin 75 extending from the inner side of the central portion 43 and projecting outwardly of the housing 41. At its outer end, the hinge pin 75 is fixedly connected to the rearward portion 33 of the toilet seat 31 by any suitable means, such as by screws (not shown), or by insertion of the hinge pin into a socket (not shown) in such manner as to prevent relative rotary movement between the hinge pin 75 and the toilet seat 31 and thereby providing for common rotary movement about the horizontal axis.

The hinge member 43 also integrally includes an eccentric or operating pin 77 which extends from the other side of the central cylindrical portion 43, which is located within the cavity 57, and which will be referred to hereinafter.

The elongated link 51 of the operating mechanism 47 can also be fabricated of any suitable plastic and includes an upper end 81 which will be referred to hereinafter and a lower stud or rod portion 83 which extends downwardly from the upper end 81 and includes a lower threaded part 85. Still more particularly, the stud or rod portion 83 extends downwardly within the cavity 57, through the bottom access opening 63, through the opening 21 in the toilet bowl 11, and beyond the lower surface 19 of the toilet bowl 11 and includes, as already indicated, at the lower end thereof, a threaded part 85.

While other specific constructions can be employed, in the disclosed construction, the means 53 for locating and tightly retaining or engaging the housing on the upper surface of the toilet bowl and for biasing the toilet seat to the raised position includes means 91 for effecting rotary movement of the hinge member 43 in response to link movement in the direction of elongation, and means 99 for biasing the link 51 for movement in the downward direction.

While other constructions ca be employed, in the disclosed construction, the means 91 for effecting rotary movement of the hinge member 43 in response to displacement of the link 51 in the direction of its elongation comprises the previously referred to eccentric pin 77 which extends from the hinge member 43 and the previously referred to upper end 81 of the stud portion 83 which includes an opening or slot 97 receiving the eccentric pin 77 so that movement of the link 51 in the direction of its elongation causes rotary movement of the hinge member 43.

While other arrangements can be employed, the eccentric pin 77 is preferably located at about a five-thirty or six o'clock position when the toilet seat 31 is in the raised or vertical position and thus would be located in a two-thirty or three o clock position or a nine or nine-thirty o'clock position (depending upon whether the assembly 25 is right hand or left handed) when the toilet seat 31 is about 90° in the horizontal position engaging the toilet bowl 11. Such engagement limits movement of the toilet seat 31 in one directed and location of the eccentric pin 77 in the five-thirty or six o clock position limits rotary movement which is effective to raise the toilet seat 31 to the vertical or raised position.

While other constructions can be employed, in the disclosed construction, the means 95 for biasing the link 51 for movement in the downward direction comprises a helical spring 99 which encircles the stud portion 83 of the elongated link 51 and which bears, at its upper end, against an upper locating washer 101 and, at its lower end, bears against a lower cupped washer 103 retained on the stud portion 83 by an adjustably located threaded nut 105.

Any suitable helical spring 99 can be employed.

The upper locating washer 101 can be fabricated of any suitable plastic and preferably includes an upper surface 111 which engages the lower surface 19 of the toilet bowl 11, a boss 113 which extends upwardly from the upper surface 111 and which is loosely received in the toilet bowl opening 21 to assist in proper location of the hinge assembly 25 on the toilet bowl 11, a lower surface 115 which bears against the upper end of the spring 99, and a central aperture or opening 117 through which the link 51 movably extends.

The lower or cupped washer 103 can be fabricated of any suitable plastic and includes an upper surface 121 which is cupped to provide a recess 123 which receives and supports the lower end of the helical spring 99, a lower surface 125, and a central aperture or opening 127 through which the link 51 extends.

The nut 105 can also be fabricated of any suitable plastic, can be of any suitable construction, and, when threaded on the threaded lower part 85 of the stud portion 83, engages the lower surface 125 of the lower washer 103 to adjustably and variably compress the helical spring 99.

In use, tightening of the nut 105 on the link 51 compresses the helical spring 99, thereby creating a force which tightly holds the housing 41 in place on the upper surface of the rearward portion 15 of the toilet bowl 11 and which biases the hinge member 43 for movement to locate the toilet seat 31 in the vertical or raised position. The nut 105 can be adjusted so that ample, but not excessive, force is available for tightly holding the housing 41 in place on the toilet bowl 11 and for biasing movement of the toilet seat 31 to the raised or vertical position, while also affording displacement of the toilet seat 31 to a horizontal position by a user when desired.

Various of the features of the invention are set forth in the following claims.

I claim:

1. A self rising toilet seat assembly comprising a toilet seat, a toilet bowl having an upper surface, a lower surface, and an opening extending between said surfaces, and a hinge assembly comprising a housing engaging said upper surface of said toilet bowl and comprising an internal cavity including a bottom opening, and a cylindrical bearing surface having a horizontally extending axis, a hinge member supported by said bearing surface for rotation about said axis and including a hinge pin extending outwardly of said housing, and fixedly engaged with said toilet seat to effect toilet seat rotation in common with rotation of said hinge member about said axis, an elongated actuating link extending through said opening in said toilet bowl and into said cavity in said housing through said bottom opening and including an upper end, and a lower stud portion having a lower threaded part, means on said upper end of said link and on said hinge member for causing rotation of said hinge member in response to link movement in the direction of link elongation, and means for biasing said link downwardly and comprising a nut adjustably threaded on said threaded lower part of said stud portion, and a helical spring located in encircling relation to said stud portion, and between said lower surface of said toilet bowl and said nut.

2. A self rising toilet seat in accordance with claim 1 wherein said means for effecting rotation of said hinge member in response to link movement comprises, on said hinge member, a pin extending in said cavity and eccentrically with respect to said horizontal axis and, on said upper end of said link, an aperture receiving said eccentric pin.

3. A self rising toilet seat in accordance with claim 2 wherein said eccentric pin is located at about six o'clock position when said toilet set is in the raised position.

4. A self rising toilet seat in accordance with claim 1 wherein said spring includes upper and lower ends, and wherein said biasing means also includes and upper washer which includes a central aperture through which said stud portion extends and which is located between said toilet bowl and said helical spring, and a lower washer which includes a central aperture through which said stud portion extends and which is located between said lower end of said helical spring and said nut.

5. A self rising toilet seat assembly comprising a toilet seat having a rearward portion, a toilet bowl having an upper surface, a lower surface, and an opening extending between said surfaces, and a hinge assembly comprising a housing engaging said upper surface of said toilet bowl and comprising an internal cavity including a bottom opening, and a cylindrical bearing surface having a horizontally extending axis, a hinge member including a cylindrical portion supported by said bearing surface for rotation about said axis, a hinge pin extending co-axially with said cylindrical portion and outwardly of said housing, and fixedly engaged with said rearward portion of said toilet seat to effect toilet seat rotation in common with rotation of said hinge member about said axis, and an operating pin extending in said cavity and located in eccentric relation to said axis, an elongated actuating link extending through said opening in said toilet bowl and into said cavity in said housing through said bottom opening and including a lower stud portion having a lower threaded part, and an upper end operably connected to said operating pin to cause rotation of said hinge member in response to link movement in the direction of link elongation, and means for biasing said link downwardly and for retaining said housing in tight engagement on said upper surface of said toilet bowl and comprising a locating washer having an upper face engaging said lower surface of said toilet bowl, a boss extending from said upper face and loosely received in said opening in said toilet bowl, a lower face, and a central aperture through which said stud portion extends, a cupped washer located in spaced relation to said locating washer and including a lower surface, an upper surface having therein a recess, and a central aperture through which said stud portion extends, a helical spring located in encircling relation to said stud portion, and between, and in engagement with, said lower surface of said locating washer and said recess in said lower washer, and a nut adjustably threaded on said threaded lower part of said stud portion and in engagement with said lower surface of said lower washer to adjustably compress said spring so as to yieldably locate said toilet seat in a vertical position and effect tight engagement of said housing on said upper surface of said toilet bowl.

6. A hinge assembly comprising a housing adapted to engage a toilet bowl and comprising an internal cavity including a bottom opening, and a cylindrical bearing surface having a horizontally extending axis, a hinge member supported by said bearing surface for rotation about said axis and including a hinge pin extending co-axially with said cylindrical portion and outwardly of said housing and adapted to be fixedly engaged with a toilet seat to effect toilet seat rotation in common with rotation of said hinge member about said axis, an elongated actuating link extending into said cavity in said housing through said bottom opening and including an upper end, and a lower stud portion having a lower threaded part, means on said upper end of said link and on said hinge member for causing rotation of said hinge member in response to link movement in the direction of link elongation, and mean for biasing said link downwardly so as to rotate said hinge member and comprising a nut adjustably threaded on said threaded lower part of said stud portion, and a helical spring located in encircling relation to said stud portion and between said toilet bowl and said nut.

7. A self rising toilet seat in accordance with claim 6 wherein said member for effecting rotation of said hinge member in response to link movement comprises, on said hinge member, a pin extending in said cavity and eccentrically with respect to said horizontal axis, and, on said upper end of said link, an aperture receiving said eccentric pin.

8. A self rising toilet seat in accordance with claim 7 wherein said eccentric pin is located at about six o'clock position when said toilet set is in the raised position.

9. A self rising toilet seat in accordance with claim 6 wherein said spring includes upper and lower ends, and wherein said biasing means also includes and upper washer which includes a central aperture through which said stud portion extends and which is located between said toilet bowl and said helical spring, and a lower washer which includes a central aperture through which said stud portion extends and which is located between said lower end of said helical spring and said nut.

10. A hinge assembly comprising a housing adapted to engage a toilet bowl and comprising an internal cavity including a bottom opening, and a cylindrical bearing surface having a horizontally extending axis, a hinge member including a cylindrical portion supported by said bearing surface for rotation about said axis, a hinge pin extending co-axially with said cylindrical portion and outwardly of said housing, and adapted to be fixedly engaged with a toilet seat to effect toilet seat rotation in common with rotation of said hinge member about said axis, and an operating pin extending in said cavity and located in eccentric relation to said axis, an elongated actuating link extending into said cavity in said housing through said bottom opening and including a lower stud portion having a lower threaded Part, and an upper end operably connected to said operating pin to cause rotation of said hinge member in response to link movement in the direction of link elongation, and means for biasing said link downwardly so as to rotate said hinge member and to retain said housing in tight engagement on the upper surface of the toilet bowl and comprising a locating washer having an upper face adapted to engage the toilet bowl, a locating boss extending from said upper face and adapted to be loosely received in the opening in the toilet bowl, a lower face, and a central aperture through which said stud portion extends, a cupped washer located in spaced relation to said locating washer and including a lower surface, an upper surface having therein a recess, and a central aperture through which said stud portion extends, a helical spring located in encircling relation to said stud portion, and between, and in engagement with, said lower surface of said locating washer and said recess in said lower washer, and a nut adjustably threaded on said threaded lower part of said stud portion and in engagement with said lower surface of said lower washer to adjustably compress said spring so as to yieldably locate the toilet seat in a vertical position and effect tight engagement of said housing on the upper surface of the toilet bowl.

11. A self rising toilet seat assembly comprising a toilet seat, a toilet bowl having an upper surface, a lower surface, and an opening extending between said surfaces, and a hinge assembly comprising a housing engaging said upper surface of said toilet bowl and comprising an internal cavity including a bottom opening, and a cylindrical bearing surface having a horizontally extending axis, a hinge member including a cylindrical portion supported by said bearing surface for rotation about said axis, a hinge pin extending co-axially with said cylindrical portion and outwardly of aid housing, and fixedly engaged with said toilet seat to cause toilet seat rotation in common with rotation of said hinge member about said axis, and an operating pin extending in said cavity and located in eccentric relation to said axis, an elongated actuating link extending through said opening in said toilet bowl and into said cavity in said housing through said bottom opening and including an upper end operably connected to said operating pin to cause rotation of said hinge member in response to link movement in the direction of link elongation, and means for biasing said link downwardly.

* * * * *